US008981224B2

(12) United States Patent
Kehl et al.

(10) Patent No.: US 8,981,224 B2
(45) Date of Patent: Mar. 17, 2015

(54) CABLE CONNECTOR SYSTEMS AND METHODS INCLUDING SAME

(71) Applicants: Tyco Electronics Raychem GmbH, Ottobrunn (DE); Tyco Electronics Corporation, Berwyn, PA (US)

(72) Inventors: Ladislaus Kehl, Unterhaching (DE); Matthew Spalding, Cornelius, NC (US)

(73) Assignees: Tyco Electronics Corporation, Berwyn, PA (US); Tyco Electronics Raychem GmbH, Ottobrunn (DE)

( * ) Notice: Subject to any disclaimer, the term of this patent is extended or adjusted under 35 U.S.C. 154(b) by 0 days.

(21) Appl. No.: 14/229,252

(22) Filed: Mar. 28, 2014

(65) Prior Publication Data

US 2014/0209379 A1 Jul. 31, 2014

Related U.S. Application Data

(63) Continuation of application No. 13/450,227, filed on Apr. 18, 2012, now Pat. No. 8,716,600.

(51) Int. Cl.

| | |
|---|---|
| ***H01R 4/00*** | (2006.01) |
| ***H01R 13/52*** | (2006.01) |
| ***H01R 4/70*** | (2006.01) |

(52) U.S. Cl.

CPC ..... *H01R 13/5202* (2013.01); *H01R 4/70* (2013.01); *H01R 13/5216* (2013.01)

USPC ..... 174/84 R; 439/797

(58) Field of Classification Search

USPC ..... 439/979, 936, 203, 204; 174/84 R, 76

See application file for complete search history.

(56) References Cited

U.S. PATENT DOCUMENTS

| | | | | |
|---|---|---|---|---|
| 3,801,730 | A | 4/1974 | Nakata et al. | |
| 4,485,269 | A | 11/1984 | Steinberg | |
| 4,511,415 | A | 4/1985 | Dienes | |
| 4,583,804 | A * | 4/1986 | Thompson | 439/588 |

(Continued)

FOREIGN PATENT DOCUMENTS

| | | | |
|---|---|---|---|
| DE | 18 93 605 | U | 5/1964 |
| EP | 1 052 657 | A2 | 11/2000 |
| WO | WO 01-63625 | A2 | 8/2001 |

OTHER PUBLICATIONS

"HVES-3-1590 15kV Class 3/C Live End Seals for PILC/VCLC Power Cable," Raychem, Tyco Electronics-Energy, PII-54695, Rev AB, PCN 707147-000, Effective Date: Mar. 1992, 9 pages.

(Continued)

*Primary Examiner* — Phuong Dinh

(74) *Attorney, Agent, or Firm* — Myers Bigel Sibley & Sajovec, PA

(57) ABSTRACT

A cable connection assembly includes an electrically conductive cable, an electrically conductive connector, and a flowable sealant. The electrical cable includes a conductor. The connector includes a connector body having an outer surface and a lengthwise connector axis. The connector body defines a conductor cavity receiving the conductor of the electrical cable. The connector further includes a sealant flow blocking wall on the connector body and extending radially outwardly from the outer surface of the connector body. The flowable sealant surrounds a portion of the connector body. The sealant flow blocking wall is configured to inhibit flow of the sealant on the outer surface along the lengthwise connector axis.

16 Claims, 13 Drawing Sheets

(56) References Cited

U.S. PATENT DOCUMENTS

| | | | | |
|---|---|---|---|---|
| 4,767,893 | A | 8/1988 | Ball et al. | |
| 4,788,245 | A | 11/1988 | Anderson | |
| 4,902,855 | A | 2/1990 | Smith | |
| 4,994,632 | A | 2/1991 | Bosisio et al. | |
| 5,408,047 | A | 4/1995 | Wentzel | |
| 5,607,167 | A | 3/1997 | Franckx | |
| 5,714,715 | A | 2/1998 | Sundhararajan et al. | |
| 5,804,767 | A * | 9/1998 | Winfield et al. | 174/74 R |
| 5,914,371 | A | 6/1999 | Mueller | |
| 6,100,472 | A | 8/2000 | Foss | |
| 6,111,200 | A | 8/2000 | De Schrijver et al. | |
| 6,520,800 | B1 | 2/2003 | Michelbach et al. | |
| 7,072,188 | B2 | 7/2006 | Janisch | |
| 2002/0040803 | A1 | 4/2002 | Buyst | |
| 2002/0046865 | A1 | 4/2002 | Bertini | |
| 2003/0207620 | A1 | 11/2003 | Haas et al. | |
| 2005/0111799 | A1 | 5/2005 | Cooke et al. | |
| 2007/0027236 | A1 | 2/2007 | Bandyopadhyay et al. | |
| 2008/0277139 | A1 | 11/2008 | Pearce | |
| 2008/0314617 | A1 | 12/2008 | Pearce et al. | |
| 2009/0065236 | A1 | 3/2009 | Taylor et al. | |
| 2009/0283294 | A1 | 11/2009 | Bukovnik | |
| 2010/0181099 | A1 | 7/2010 | Kameda et al. | |

OTHER PUBLICATIONS

"HVS-T-15903 15kV Class Trifurcating Splice for 3/C/ PILC Power Cables," Raychem, Tyco Eleclronics-Energy, PII-54923, Rev AC, PCN 670793-000, Effective Date: Jan. 25, 1999, 14 pages.

"HVSY-1582D 15kV Class Splice for PILC-to-PILC or PILC-to-Extruded Dielectric (poly-EPR) Power Cable," Raychem, Tyco Electronics-Energy, PII-54866, Rev AD, PCN 528421-000, Effective Date: Mar. 14, 2000, 14 pages.

"Raychem cold applied transition joint CATJ for 3-core paper insulated cables to polymeric insulated cables up to 36 kV," http://energy.te.com/PDF/EPP_1695.pdf, Tyco Electronics Raychem GmbH, Energy Division, 4 pages, Aug. 2009.

Notification of Transmittal of the International Search Report and the Written Opinion of the International Searching Authority, or the Declaration in corresponding PCT Application No., PCT/US2013/035883 mailed Jul. 9, 2013 (12 pages).

Notification Concerning Transmittal of International Preliminary Report on Patentability in corresponding PCT Application No. PCT/US2013/035883, mailed Oct. 30, 2014 (9 pages).

* cited by examiner

CABLE CONNECTOR SYSTEMS AND METHODS INCLUDING SAME

RELATED APPLICATION(S)

The present application is a continuation of and claims priority from U.S. patent application Ser. No. 13/450,227, filed Apr. 18, 2012, the disclosure of which is incorporated herein by reference in its entirety.

FIELD OF THE INVENTION

The present invention relates to electrical cables and, more particularly, to connections and covers for electrical transmission cables.

BACKGROUND OF THE INVENTION

Covers are commonly employed to protect or shield electrical power cables and connections (e.g., low voltage cables up to about 1000V and medium voltage cables up to about 65 kV). Mastic is commonly used to provide electrical stress relief in areas proximate connectors that might otherwise present voids or other undesirable irregularities.

One application for such covers is for splice connections of metal-sheathed, paper-insulated cables such as paper-insulated lead cable (PILC). A PILC typically includes at least one conductor surrounded by an oil-impregnated paper insulation layer, and a lead sheath surrounding the conductor and insulation layer. Alternatively, the metal sheath may be formed of aluminum. In some cases, it is necessary to contain the oil. It is known to use a heat shrinkable sleeve made of a polymer that does not swell when exposed to the oil. Examples of such heat shrinkable sleeves include heat shrinkable oil barrier tubes (OBT) available from TE Connectivity. The sleeve is placed over the oil impregnated paper and heat is applied to contract the sleeve about the insulation layer. Mastic or other sealant material may be used at each end of the sleeve to ensure an adequate seal and containment of the oil.

SUMMARY OF THE INVENTION

According to embodiments of the present invention, a cable connection assembly includes an electrically conductive cable, an electrically conductive connector, and a flowable sealant. The electrical cable includes a conductor. The connector includes a connector body having an outer surface and a lengthwise connector axis. The connector body defines a conductor cavity receiving the conductor of the electrical cable. The connector further includes a sealant flow blocking wall on the connector body and extending radially outwardly from the outer surface of the connector body. The flowable sealant surrounds a portion of the connector body. The sealant flow blocking wall is configured to inhibit flow of the sealant on the outer surface along the lengthwise connector axis.

According to embodiments of the present invention, a cable connector system kit for electrically and mechanically connecting an electrical cable includes an electrically conductive connector. The connector includes a connector body and a sealant flow blocking wall on the connector body. The connector body has an outer surface and a lengthwise connector axis. The connector body defines a conductor cavity to receive a conductor of the electrical cable. The sealant flow blocking wall extends radially outwardly from the outer surface of the connector body. The sealant flow blocking wall is configured to inhibit flow of a sealant on the outer surface along the lengthwise connector axis.

According to method embodiments of the present invention, a method for forming an electrical and mechanical connection with an electrical cable includes providing an electrically conductive connector including: a connector body having an outer surface and a lengthwise connector axis, the connector body defining a conductor cavity to receive a conductor of the electrical cable; and a sealant flow blocking wall on the connector body and extending radially outwardly from the outer surface of the connector body. The method further includes mounting a flowable sealant on the connector such that the flowable sealant surrounds a portion of the connector body. The sealant flow blocking wall is configured to inhibit flow of the sealant on the outer surface along the lengthwise connector axis.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
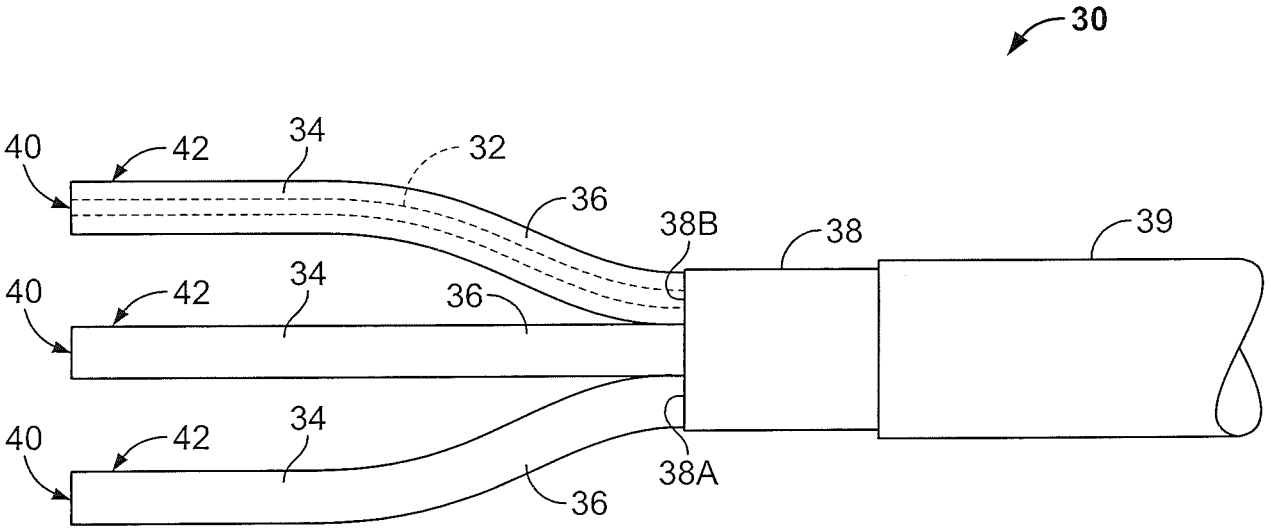
FIG. 1 is a side view of an exemplary PILC cable having three cable cores.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

As used herein, "monolithic" means an object that is a single, unitary piece formed or composed of a material without joints or seams.

Figure 6:
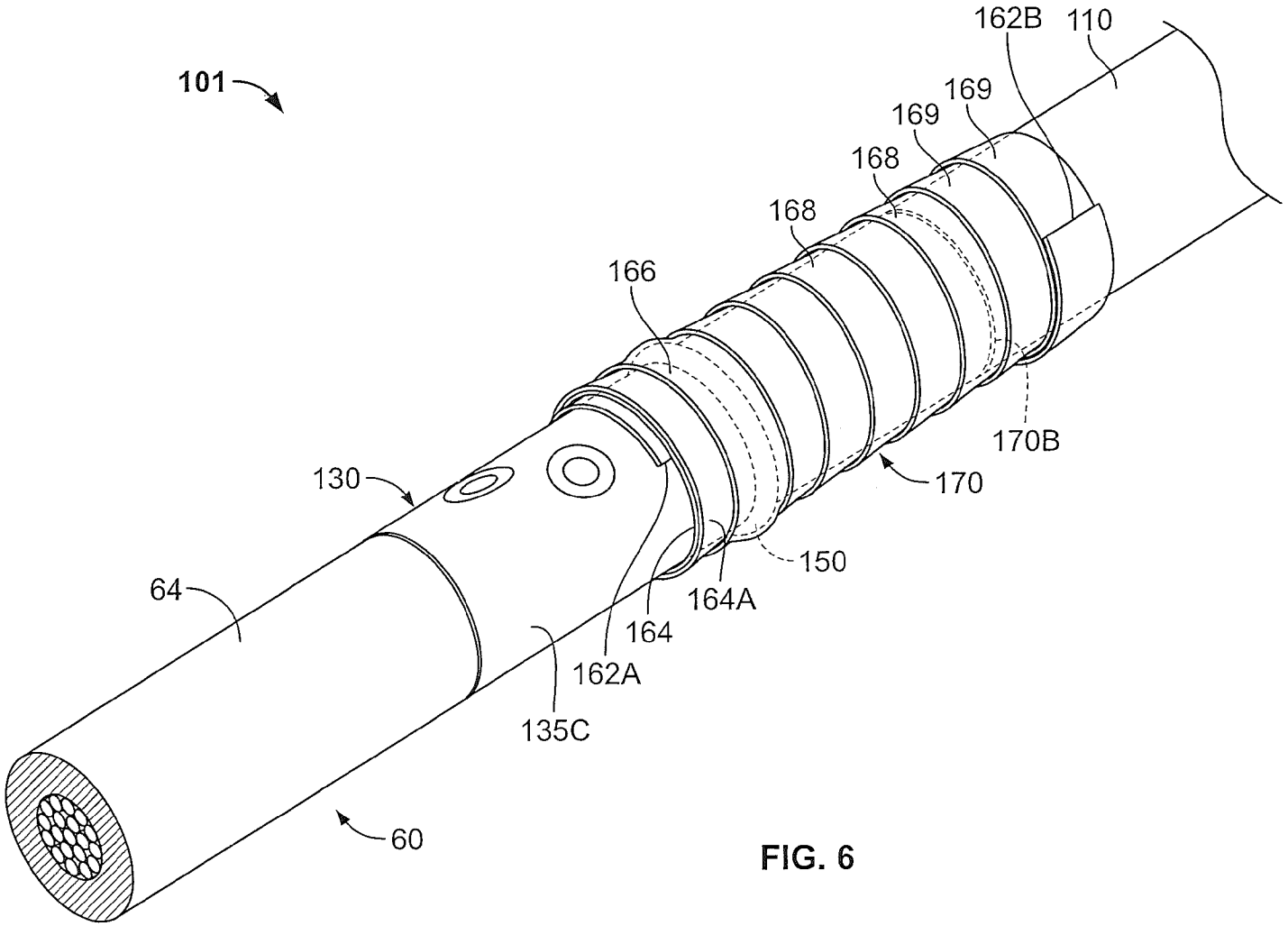
FIG. 6 is a perspective view of the assembly of FIG. 5 further including a restricting tape applied around the connector and mastic.
Figure 7:
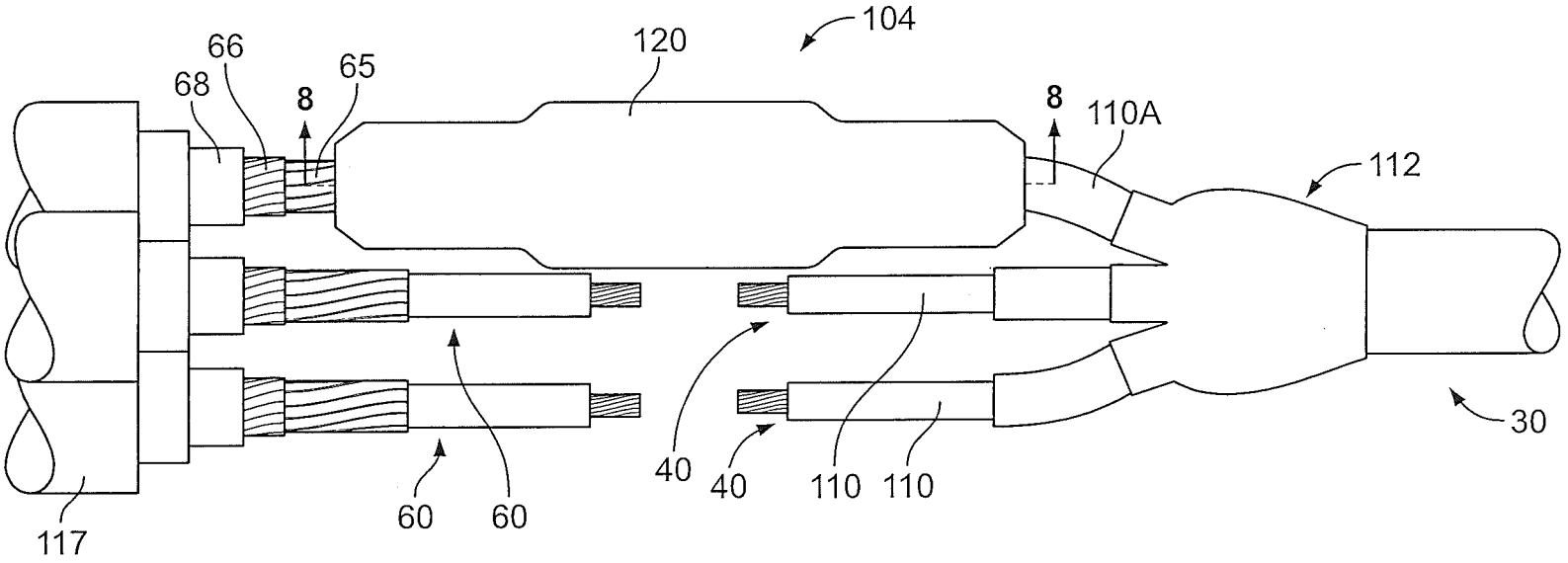
FIG. 7 is a side view of the PILC cable of FIG. 1, the three polymeric cables, and the assembly of FIG. 6, and further including a joint body installed about the connector and portions of the spliced PILC cable core and polymeric cable.
Figure 10:
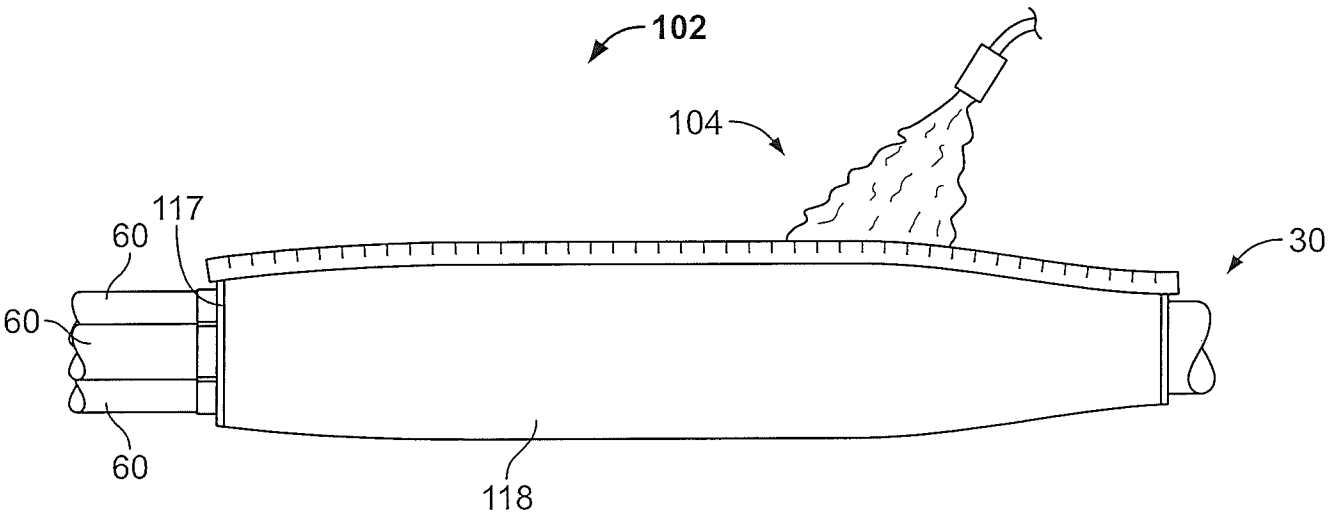
FIG. 10 is a side view of the assembly of FIG. 7 with a re-jacketing sleeve mounted thereon.

With reference to FIG. 6, a cable connector system 101 according to some embodiments of the present invention is shown therein. The connector system 101 can be used in combination with additional components to form a cover system 104 (FIG. 7). The cover system 104 may in turn be used to form a protected connection assembly 102 including two or more connected cables, as shown in FIG. 10. In some embodiments, the connector system 101 is provided as a pre-packaged kit of components for subsequent assembly by an installer (e.g., a field installer) using a method as described herein.

The connector system 101 can be used to electrically and mechanically couple or splice a pair of electrical power transmission cables. The spliced cables may include polymeric insulated cables, paper-insulated lead cables (PILC), or one of each. In the embodiment illustrated in FIGS. 1-10 and described hereinbelow, the connector system 101 is used to couple (i.e., provide a transition joint or transition splice between) an oil-containing cable (PILC) 30 and a polymeric cable 60. However, it will be appreciated that other combinations of conductors may be joined in accordance with embodiments of the invention.

The cable 30 (FIG. 1) as illustrated is a three-phase cable including three electrical conductors 32, which may be formed of any suitable material such as copper, and may be solid or stranded. Each conductor 32 is surrounded by a respective oil-impregnated paper insulation layer 34. The oil impregnating each layer 34 may be any suitable oil such as a mineral oil. A respective metal screen 36 may surround each paper layer 34. A metal sheath 38 surrounds the three conductors 32, collectively. According to some embodiments, the metal sheath 38 is a lead sheath and the cable 30 may be commonly referred to as a paper-insulated lead cable (PILC). According to other embodiments, the metal sheath 38 is formed of aluminum. A polymeric jacket 39 surrounds the metal sheath 38.

Figure 2:
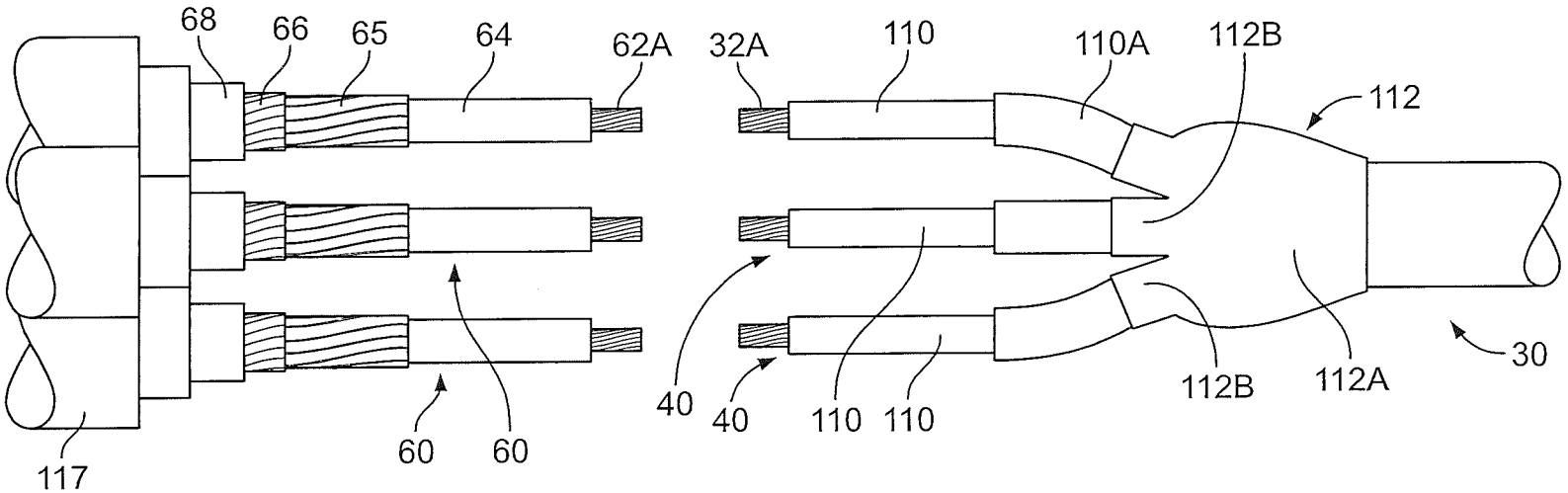
FIG. 2 is a side view of the PILC cable of FIG. 1 and three polymeric cables prepared for splicing.
Figure 3:
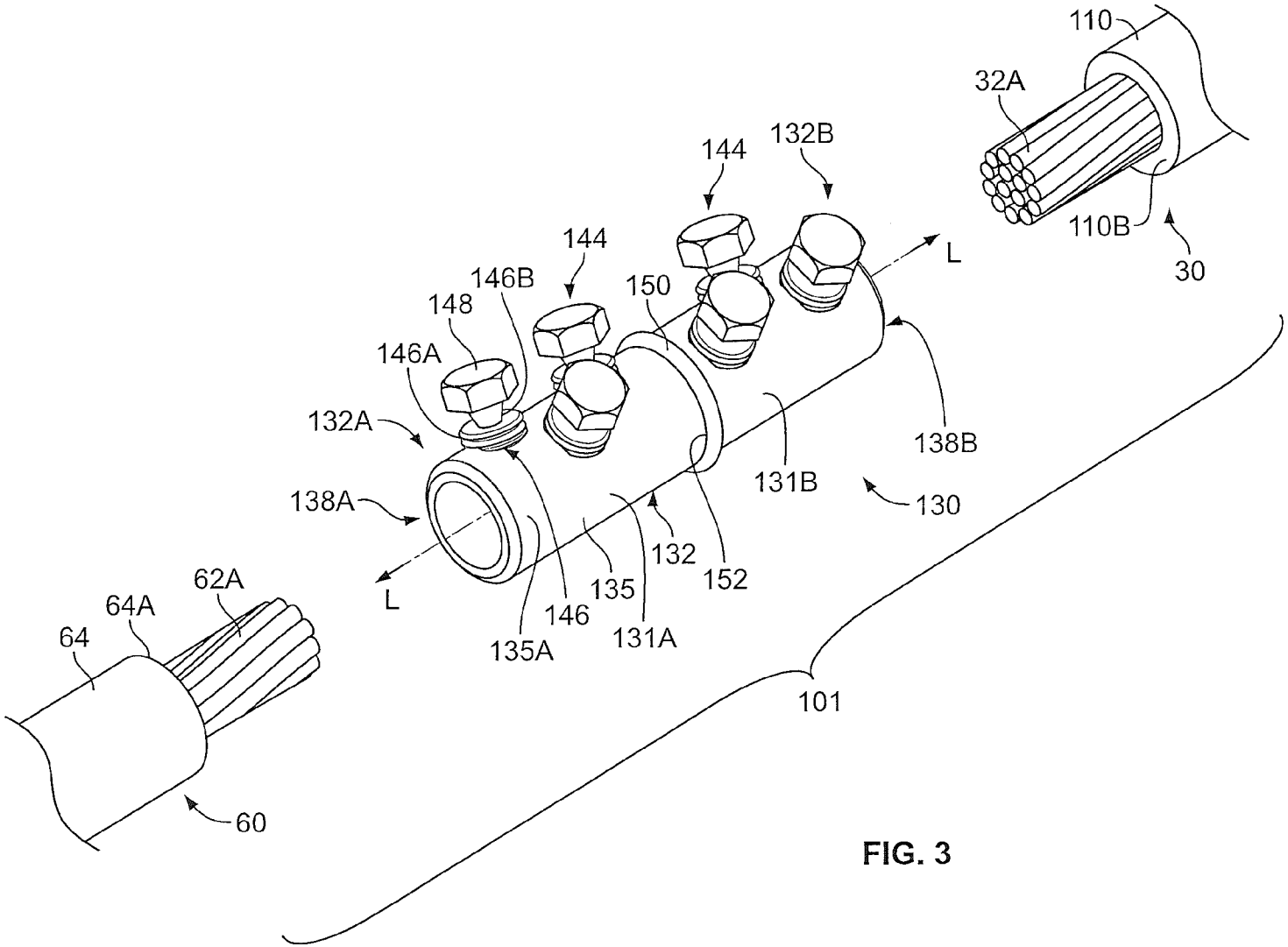
FIG. 3 is an exploded, perspective view of a connector according to embodiments of the present invention along with one of the PILC cable cores (covered by an oil barrier tube) and one of the polymeric cables to be coupled.

In the illustrated embodiment, the three conductors 32 of the cable 30 are each spliced to a respective one of three polymeric cables 60. As shown in FIG. 2, each polymeric cable 60 includes a primary electrical conductor 62, a polymeric conductor insulation layer 64, a semiconductive layer 65, one or more neutral conductors 66, and a jacket 68, with each component being concentrically surrounded by the next. According to some embodiments and as shown, the neutral conductors 66 are individual wires, which may be helically wound about the semiconductive layer 65. The primary conductor 62 may be formed of any suitable electrically conductive materials such as copper (solid or stranded). The polymeric insulation layer 64 may be formed of any suitable electrically insulative material such as crosslinked polyethylene (XLPE) or EPR. The semiconductive layer 65 may be formed of any suitable semiconductor material such as carbon black with silicone. The neutral conductors 66 may be formed of any suitable material such as copper. The jacket 68 may be formed of any suitable material such as EPDM.

However, it will be appreciated that polymeric cables of other types and configurations may be used with the connector system 101. For example, the polymeric cable may include three conductors, each surrounded by a respective polymeric insulation and a respective semiconductive elastomer, and having a metal shield layer collectively surrounding the three conductors and a polymeric jacket surrounding the shield layer.

In the illustrated embodiment, three connector systems 101 may be employed (one for each phase). The three connector systems 101 may be constructed in the same or similar manner and therefore only one of the connector systems will be described in detail hereinbelow, and this description will likewise apply to the other connector systems. However, the connector systems 101 employed to splice a group of cables need not be identical.

The connector system 101 includes a mechanical and electrical connector 130 (FIG. 3), a mass of a flowable sealant material 170 (FIG. 5), and a mastic pressure retention or restricting tape 160 (FIG. 6). According some embodiments and as described hereinbelow, the flowable sealant material 170 is a mastic.

According to some embodiments and as shown, the connector 130 (FIGS. 3, 8 and 9) is a shear bolt connector 130. The shear bolt connector 130 includes an electrically conductive (e.g., metal) connector body 132 and a plurality of shear bolts 144. The connector 130 may also include one or a pair of spacer inserts (not shown). The connector body 132 has a lengthwise axis L-L (FIG. 3) and opposed ends 132A, 132B. The connector body 132 has an intermediate or central oil stop wall 134 (FIG. 8) and a tubular sidewall 135 forming opposed body portions 131A, 131B. The inner surface of the sidewall 135 and the oil stop wall 134 define opposed conductor cavities or bores 136A, 136B (FIG. 8) on either side of the wall 134, as well as opposed entry openings 138A and 138B (FIG. 3) on each end 132A, 132B communicating with the bores 136A and 136B, respectively. An annular end face on the end 136A surrounds the entry opening 138A. An annular end face on the end 136B surrounds the entry opening 138B. Threaded bolt bores 142 (FIG. 8) are defined in the sidewall 135 of the connector body 132.

Each bolt 144 (FIG. 3) includes a shank 146 and a head 148. The head 148 may be configured to operably engage a driver to be forcibly driven by the driver. The shank 146 includes a threaded section 146A configured to threadedly engage an associated one of the bolt bores 142. The shank 146 also includes a breakaway section 146B between the threaded section 146A and the head 148. Each bolt 144 is adapted to be screwed down into its respective bolt bore 142 to clamp a conductor 32, 62 in the underlying conductor bore 136A or 136B. The head 148 on the bolt 144 is configured to shear off of the threaded shank 146A at the breakaway section 146B when subjected to a prescribed torque. According to some embodiments, the bolt 144 is formed of copper or aluminum.

An annular seat or groove 152 (FIGS. 3 and 9) is defined in the outer surface 135A of the connector body 132. The groove 152 may be generally U-shaped in cross-section. In some embodiments, the groove 152 is located substantially axially coincident with or proximate the oil block wall 134. An endless ring member 150 is seated in the groove 152. According to some embodiments and as shown, the ring member 150 is an O-ring. The O-ring 150 serves as a sealant flow block wall, as discussed herein.

Figure 9:
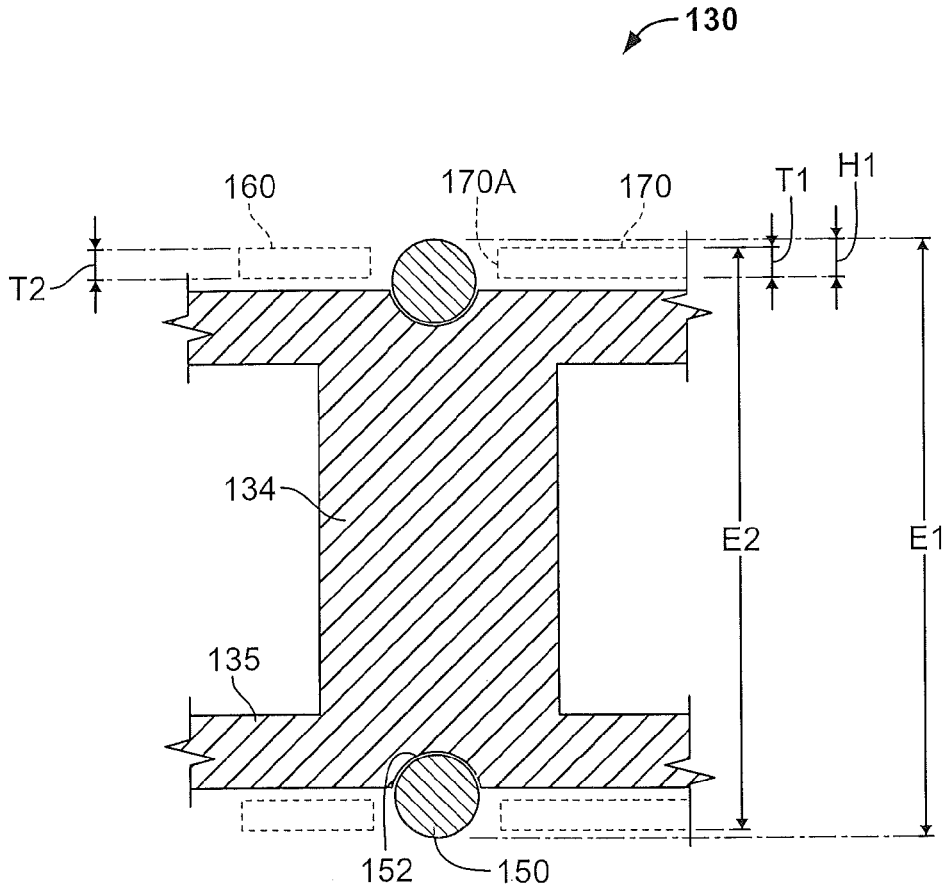
FIG. 9 is an enlarged, fragmentary, cross-sectional view of the connector of FIG. 3.

The O-ring 150 circumferentially surrounds the connector body 132 and extends radially outwardly from the outer surface 135A a distance or height H1 (FIG. 9). According to some embodiments, the height H1 is substantially uniform, about the full length of the O-ring 150. According to some embodiments, the height H1 is at least 0.25 mm and, in some embodiments, is in the range of from about 1 mm to 5 mm.

The O-ring 150 may be formed of any suitable material. According to some embodiments, the O-ring 150 is formed of a resiliently deformable material. According to some embodiments, the O-ring 150 is formed of an elastomeric material. According to some embodiments, the O-ring 150 is formed of silicone rubber. Other suitable elastomeric materials may include ethylene-propylene-diene-monomer (EPDM) rubber, butyl rubber or nitrile rubber. However, silicone rubber may be particularly advantageous because silicone rubber is stable over a wide service temperature range, is highly resistant to oil absorption, and will not degrade when subjected to oil (in particular, mineral oil from the cable 30).

According to some embodiments, the O-ring 150 has a Shore A hardness in the range of from about 30 to 80.

The O-ring 150 may be formed using any suitable technique. According to some embodiments, the O-ring 150 is molded or extruded and, according to some embodiments, injection molded. Alternatively, the O-ring 150 may be stamped. According to some embodiments, the O-ring 150 is monolithic.

The mastic 170 (FIGS. 5 and 8) is a sealing material that is flowable within its intended service temperatures. According to some embodiments, the intended service temperatures are in the range of from about −40° C. to 140° C. According to some embodiments, the mastic 170 has a viscosity in the range of from about 50 to 100 mooney units at 100° C.

The mastic 170 may be any suitable sealing mastic. According to some embodiments, the mastic 170 is resistant to chemical attack from oil, and resistant to migration of oil therethrough. According to some embodiments, the mastic 170 is formed of nitrile rubber, epichlorhydrin rubber, or fluorinated rubber. The mastic 170 may include a stress relief material such as carbon black. According to some embodiments, the mastic 170 has a permittivity of about 7 or higher. Suitable mastics include the S1189 and SRM mastics available from TE Connectivity.

The restricting tape 160 (FIGS. 6 and 8) may be any suitable tape. According to some embodiments, the restricting tape 160 is self-adhesive or otherwise adherent to the material (e.g., copper or aluminum) of the connector 130 and the material (e.g., silicone rubber) of the O-ring 150. According to some embodiments, the restricting tape 160 is a self-amalgamating sealing tape. In some embodiments, the tape 160 is a fiber-reinforced silicone tape. According to some embodiments, the restricting tape 160 includes a silicone tape impregnated with a substrate (in some embodiments, a fabric mesh) that limits the permitted extent of elongation of the restricting tape 160. In some embodiments, elongation of the restricting tape 160 is limited to from about 5 to 25%. Suitable restricting tapes may include EXRM-3020 tape available from TE Connectivity.

The cover system 104 may further include three tubular oil barrier tubes (OBTs) 110 (FIG. 2), a PILC breakout 112 (FIG. 2), three tubular splice or joint bodies 120 (FIGS. 7 and 8), a polymeric cable breakout 117 (FIG. 2), and a re-jacketing sleeve 118 (FIG. 10). The cover system 104 may also include shielding material (e.g., mesh or tape), sealants (e.g., mastic), tapes, spacer(s), ground conductors, and/or other components as appropriate to effect the desired electrical and mechanical joint.

Each OBT 110 (FIG. 2) may be formed of any suitable material. According to some embodiments, each OBT 110 is formed of an electrically insulative material and may include an electrically conductive semiconductive layer 110A (which may be integrally formed with the OBT 110 or a separate tube mounted thereover). According to some embodiments, each OBT 110 is formed of an elastically expandable material, which may be an elastomeric material. Suitable materials for the OBTs may include EPDM, neoprene, butyl or polyurethane. Each OBT 110 may be initially mounted on a holdout (not shown).

The breakout 112 (FIG. 2) may include a main tubular body 112A and three circumferentially distributed tubular fingers 112B integral with the main body. The breakout 112 may be formed of any suitable material. According to some embodiments, the breakout 112 is formed of an electrically insulative material. According to some embodiments, the breakout 112 is formed of an elastically expandable material such as an elastomeric material. Suitable materials may include EPDM, neoprene, butyl, polyurethane, silicone or fluorosilicone.

Figure 8:
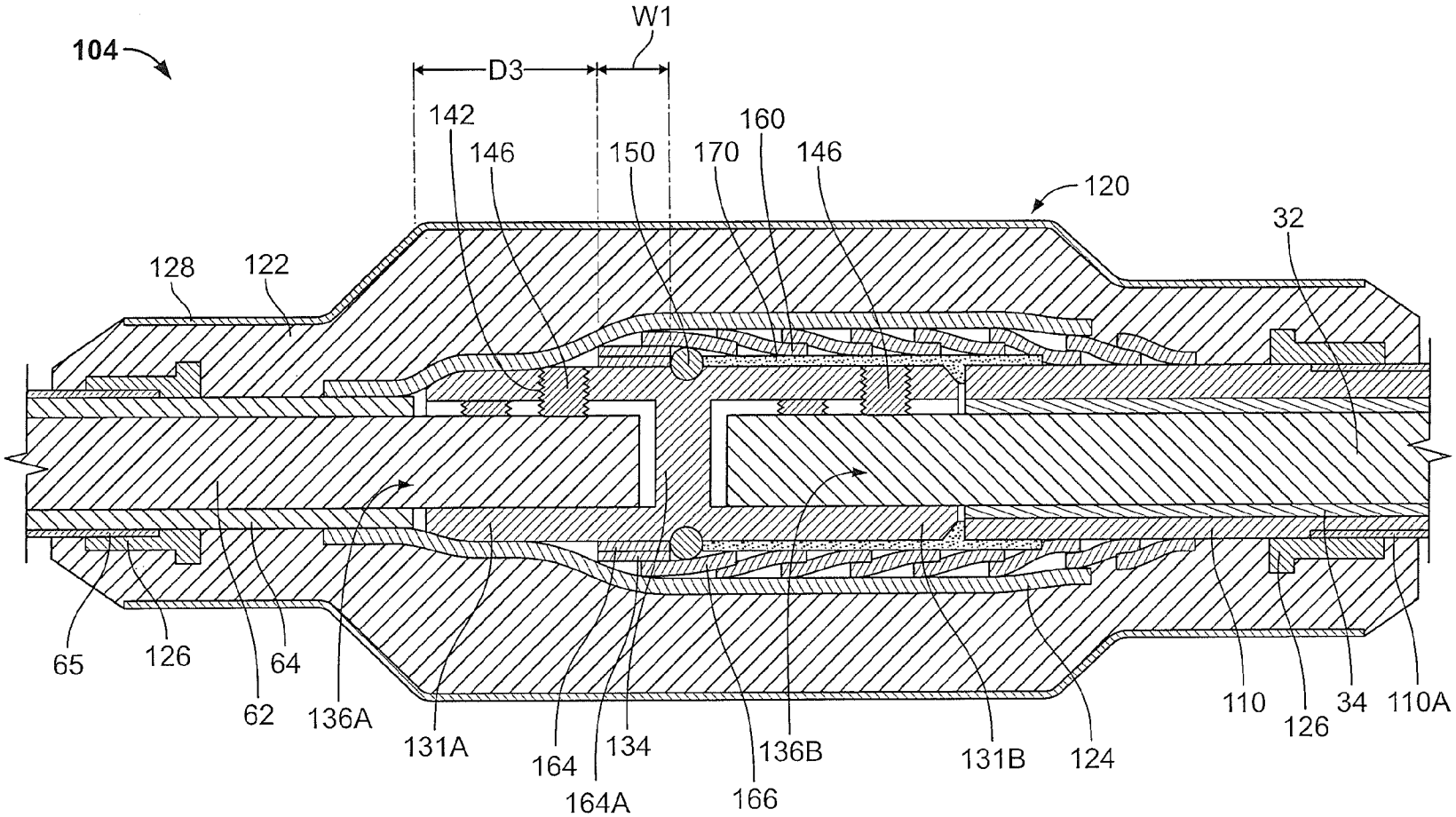
FIG. 8 is a cross-sectional view of the assembly of FIG. 7 taken along the line 8-8 and FIG. 7.

The joint bodies 120 (FIGS. 7 and 8) may be of any suitable construction and materials, and may function as electrical stress control tubes. With reference to FIG. 8, each joint body 120 may include a tubular elastomeric, electrically insulative layer 122 and one or more integrated electrically semiconductive layers, for example, as known in the art for controlling electrical stresses, providing electrical shielding and bridging the electrically semi-conductive layers of the cables. In particular, the joint body 120 may include an electrically conductive region in the form of electrically conductive geometrical Faraday cage 124. The joint body 120 may further include electrically conductive regions in the form of electrically conductive geometrical stress cones 126. A semiconductive coating or layer 128 may be provided on the outer surface of the layer 122. The components 122, 124, 126, 128 may be formed of any suitable materials. According to some embodiments, the layer 122 is formed of silicone rubber. According to some embodiments, the Faraday cage 124 and the stress cones 126 are formed of conductive polymers (according to some embodiments, having a resistivity of 100 ohm-cm or less). According to some embodiments, the outer layer 128 is formed of silicone, EPR, EPDM or polyethylene.

The breakout 117 (FIG. 2) includes a main tubular body and three circumferentially distributed tubular fingers integral with the main body. The breakout 117 may be formed of any suitable material. According to some embodiments, the breakout 117 is formed of an electrically insulative material. According to some embodiments, the breakout 117 is formed of an elastically expandable material such as an elastomeric material. Suitable materials may include EPDM, neoprene, butyl, polyurethane, silicone or fluorosilicone.

The re-jacketing sleeve 118 (FIG. 10) may be of any suitable construction and materials. Suitable materials for the re jacketing sleeve 118 may include polyethylene, thermoplastic elastomer (TPE), or silicone rubber, for example. Suitable re-jacketing sleeves may include a heat shrinkable re-jacket (as shown) or the GMRS Rejacketing Sleeve available from TE Connectivity, for example.

The constructions of the connector system 101 and the cover assembly 102 may be further appreciated in view of methods for forming the connection assembly 104 (FIGS. 7 and 8) according to embodiments of the present invention, as discussed in further detail below. However, it will be appreciated that certain of the steps and components disclosed hereinbelow may be altered or omitted in accordance with further embodiments of the invention.

With reference to FIGS. 1 and 2, the cable 30 is prepared by progressively trimming back or removing end sections of the jacket 39, the metal sheath 38, and the metal screen 36 as shown. The paper insulation 34 of each conductor 32 may also be trimmed back or may be subsequently trimmed prior to installing the connectors 50. Each conductor 32 and the paper insulation 34 surrounding the conductor 32 may be referred to herein as a cable core 40. The metal sheath 38 has a terminal edge 38A defining an end opening 38B through which extended sections 42 of the three cable cores 40 extend. The paper insulation 34 of each cable core 40 is trimmed back as shown in FIG. 2 to expose a terminal or engagement section 32A of the conductor 32.

As shown in FIG. 2, an OBT 110 is mounted on each cable core 40 and the breakout 112 is mounted over the OBTs 110.

Each cable 60 is prepared by cutting each layer 62, 64, 65, 66 and 68 such that a segment of each layer 62, 64, 65 and 66 extends beyond the next overlying layer 64, 65, 66 and 68 as shown in FIG. 2. A terminal or engagement section 62A of the conductor 62 extends outwardly beyond the insulation 64.

The following procedure can be executed for each of the cable core 40/polymeric cable 60 pairs in turn.

Figure 4:
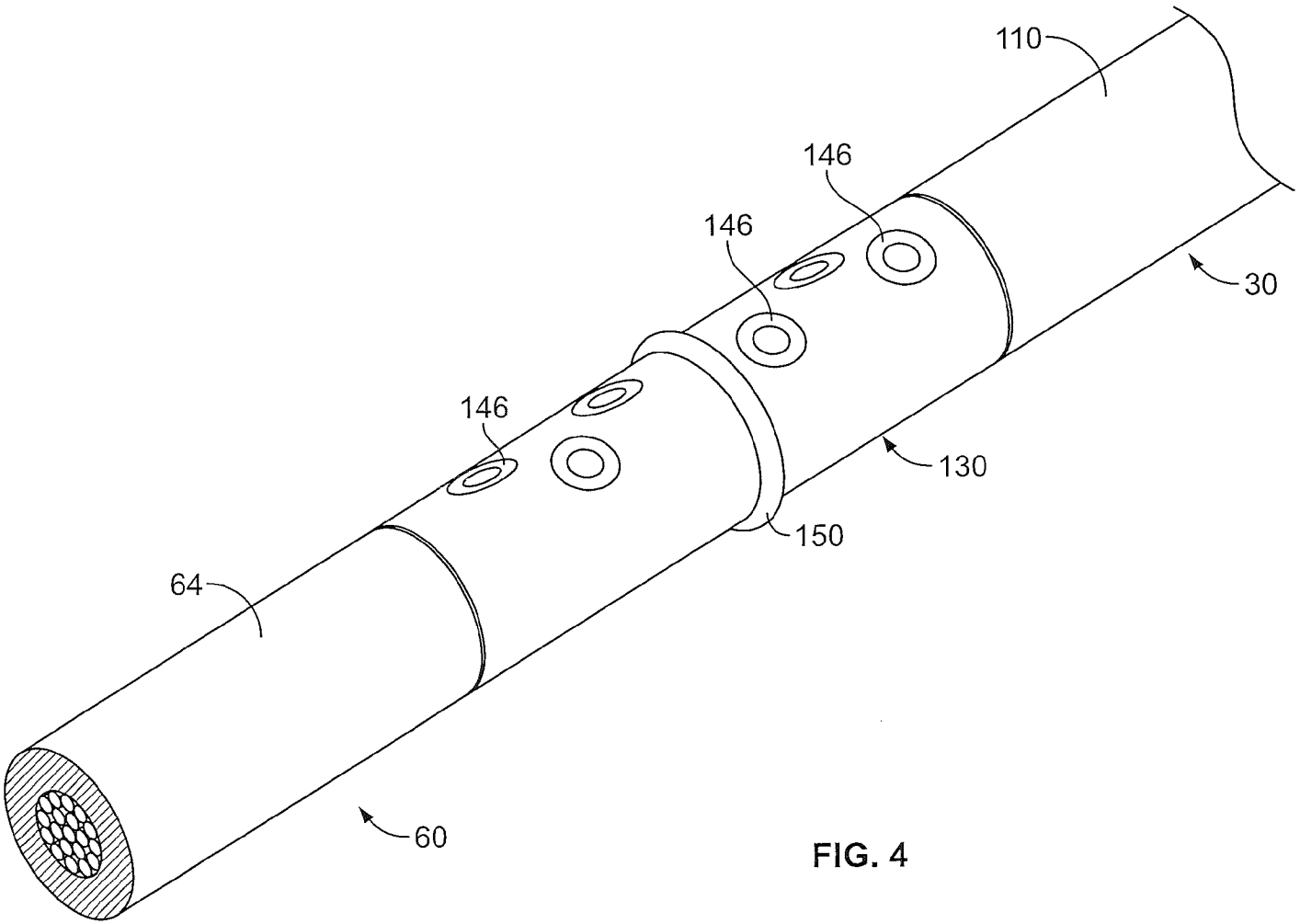
FIG. 4 is a perspective view of the connector of FIG. 3 connecting the PILC cable core and the polymeric cable, wherein shear bolts of the connector have been sheared off.

The end segment of the conductor 62 is inserted into the bore 136A. The bolts 144 overlying the bore 136A are driven into the bore 136A via their heads 148 until sufficient torque is applied to shear the head 148 off at the breakaway section 146. The intruding bolts 144 may tend to forcibly radially displace the conductor 64 in the offset direction O with respect to the bore centerline. At this time, the end segment of the conductor 62 is secured in the bore 136A by the remainder of each bolt 144, as shown in FIGS. 4 and 7.

The cable core 40 is likewise coupled to the connector 130. More particularly, the end segment of the conductor 32 is inserted into the bore 136B and captured therein by the bolts 144 as shown in FIGS. 4 and 7.

Figure 5:
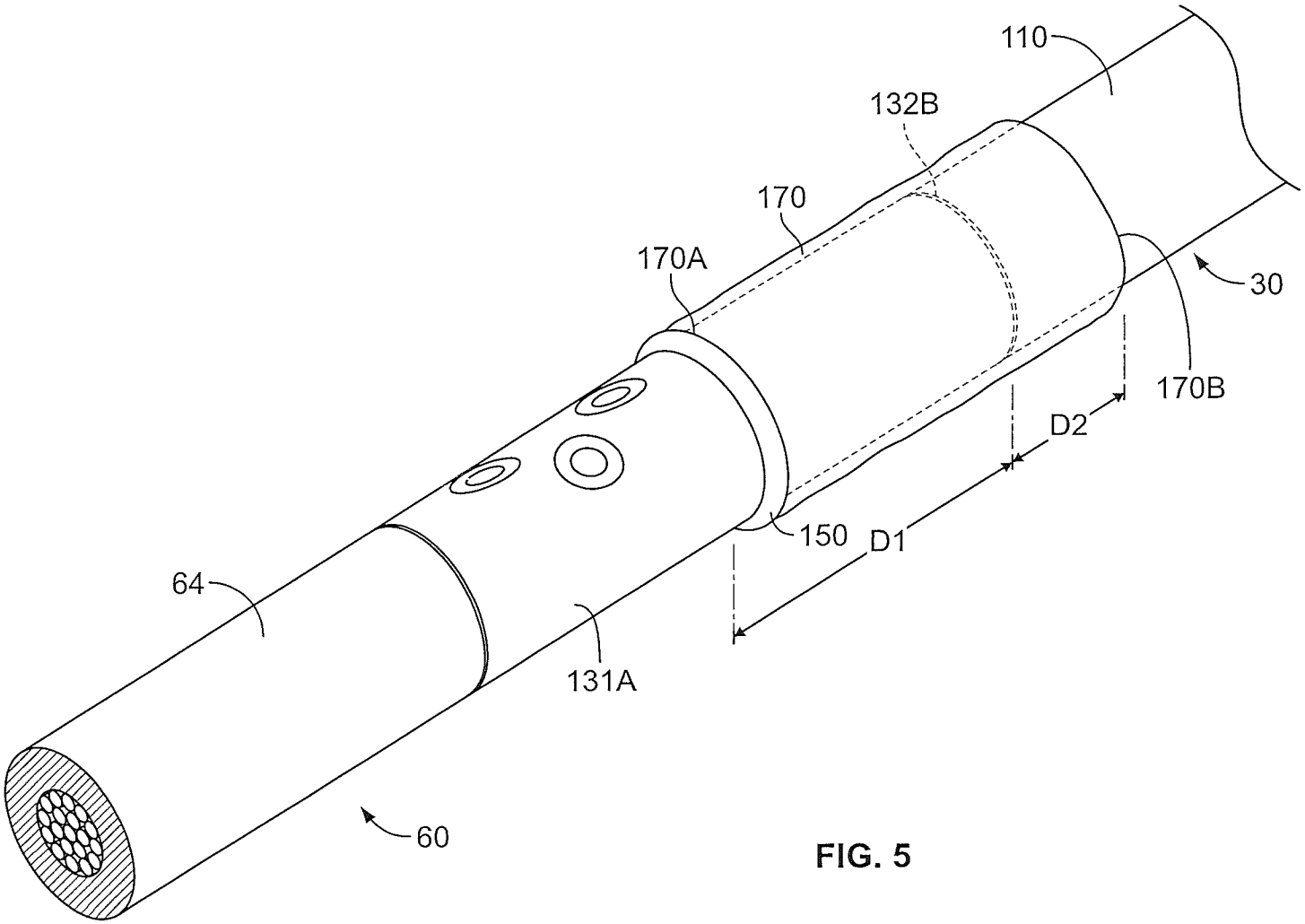
FIG. 5 is a perspective view of the assembly of FIG. 4 further including a layer of mastic applied around the connector and the oil barrier tube on the PILC cable core.

The mastic 170 is then wrapped about the cable core 40 and the connector 130 as shown in FIG. 5. More particularly, a strip or strips of the mastic 170 can be wrapped or wound onto the cable core 40 and the connector 130 such that a portion 172 of the mastic 170 fully circumferentially surrounds the portion 131B of the connector body 132 and a portion 174 of the mastic 170 overlaps (fully circumferentially surrounding) a portion of the OBT 110 adjacent the connector 130. According to some embodiments, the mastic 170 directly engages and adheres to the overlapped outer surfaces of the connector 130 and the OBT 110. The mastic 170 extends from a terminal end 170A to a terminal end 170B. The terminal end 170A is located proximate the O-ring 150 on the side of the O-ring 150 facing the connector end 132A.

According to some embodiments, the mastic 170 overlaps the connector 130 by a distance D1 (FIG. 5) of at least about 0.25 inch and, in the event a potential leak path is present such as a bolt hole, the mastic 170 should overlap at least 0.25 inch of solid portion of the connector 130. According to some embodiments, the mastic 170 overlaps the OBT 110 by a distance D2 of at least about 0.25 inch. According to some embodiments, the mastic 170 does not overlap any of the connector body portion 131A.

With reference to FIGS. 6 and 8, the restricting tape 160 is then installed on the connector 130. Beginning with a lead end 162A of the tape 160 and ending with a trailing end 162B, the tape 160 is wound helically in a self-overlapping or imbricated pattern about the connector 130, the mastic 170, and the OBT 110. More particularly, a first winding 164 of the tape 160 directly engages and adheres to the outer surface 135A (FIG. 3) of the connector body portion 131A, a subsequent (e.g., third, as shown) winding 166 directly engages and adheres to the O-ring 150, further subsequent windings 168 surround the mastic 170, and finally one or more windings 169 directly engage and adhere to the OBT 110. Optionally, one or more additional full windings 164A may be wrapped about the first winding 164. According to some embodiments, the tape 160 is wound on under tension so that, once installed, the tape 160 applies a persistent radially compressive load or pressure on the mastic 170.

As will be appreciated from FIG. 8, the connector body portion 131B, the tape 160, the O-ring 150, and the OBT 110 envelope and collectively define a chamber containing the mastic 170, and thereby contain the mastic 170 in the region of the interface between the OBT 110 and the connector 130. The mastic 170 retained in this region is thus in place to serve as an oil barrier seal, and may also serve as an electrical stress control layer. Notably, a portion 135C (FIG. 6) of the outer surface 135A on the connector body portion 131A remains exposed.

According to some embodiments, the thickness T1 (FIG. 9) of the mastic 170 at the terminal end 170A is in the range of from about 1 mm to 4 mm. According to some embodiments, the height H1 of the O-ring 150 is equal to or greater than the thickness T1 of the mastic 170 to prevent or inhibit the mastic 170 from flowing over the O-ring 150. According to some embodiments, the outer diameter E1 of the O-ring 150 is equal to or greater than the mastic outer diameter E2 (FIG. 9).

According to some embodiments, the nominal thickness of the mastic 170 in the region surrounding the connector body portion 131B is in the range of from about 1 mm to 3 mm.

According to some embodiments, the tape 160 has a width W1 (FIG. 8) in the range of from about 0.5 inch to 1 inch. According to some embodiments, the thickness T2 (FIG. 9) of the restricting tape 160 at the beginning of first wind 164 is in the range of from about 0.25 mm to 2 mm. According to some embodiments, the height H1 of the O-ring 150 is equal to or greater than the tape thickness T2 (FIG. 9). According to some embodiments, the height H1 is at least 0.5 mm greater than the tape thickness T2. According to some embodiments, the height H1 is at least twice the tape thickness T2.

The joint body 120 is then mounted around the connector 130, the mastic 170, the restricting tape 160, and adjacent portions of the cables 30, 60 as shown in FIGS. 7 and 8. The joint body 120 may be provided on and deployed from a holdout, for example. The joint body 120 overlaps a portion of the semiconductive layer 65 on one end and a portion of the OBT semiconductive layer 110A on the other end. More particularly, one stress cone 126 overlaps the semiconductive layer 65 and the insulation layer 64 at their interface, the other stress cone 126 overlaps the OBT semiconductive layer 110A and the exposed OBT 110 at their interface, and the faraday cage 124 surrounds the full length of the connector 130 and adjacent portions of the cable insulation 64 and the OBT 110. A portion of the Faraday cage 124 directly engages the bare or exposed connector outer surface 135C to provide electrical continuity therebetween.

Each of the other cable pairs can be connected and covered in the same manner as described above using respective connector systems 101. The assembly can thereafter be grounded, shielded and re-jacketed in known manner, for example. For example, grounding braids can be connected to the shield layers 68 of the polymeric cables 60 and the metal sheath 30 by clamps or the like. The entire joint assembly can be covered by the re-jacketing sleeve 118 (FIG. 10), which overlaps the cable jacket 39 and the jackets 68.

The connector system 101 can provide significant advantages and overcome or mitigate problems commonly associated with similar connections of the known art. In the case of the joint between the connector 130 and the cable 30, the mastic 170 may be relied upon to prevent or inhibit oil from leaking from the cable 30 (e.g., by sealing the open end of the OBT 110). The mastic 170 may also be relied upon to provide electrical stress relief at the joint and the unintended loss of the mastic 170 from the sealing region can therefore risk failure or degradation of the splice due to electrical stresses. In known connection assemblies in which a restricting tape is used to contain the mastic, the configuration of the tape wraps may leave a flow path for the mastic to flow under the restricting tape and thereby compromise the seal. This is particularly the case where the lead end of the tape is located adjacent the end of the mastic on the connector (i.e., the end of the mastic layer nearest the polymeric cable) because the thickness of the tape end can create a step and a corresponding void between the tape and the connector. While this problem may be mitigated by providing additional wraps of the tape onto the connector portion adjacent the polymeric cable, such additional wraps are often undesirable because they reduce the exposed connector surface available for engagement by the joint body Faraday cage.

The O-ring 150 provides a continuous region to seal with the restricting tape 160 and restrict the flow of the mastic 170. By preventing or inhibiting displacement of the mastic 170, the connector system 101 (in particular, the O-ring 150 and the tape 160, cooperatively) can preserve the integrity of the mastic oil stop seal to retain the oil in the PILC cable 30 even when relatively high oil internal pressures are induced, such as by increases in temperature or placement of the connection at lower elevation than other parts of the cable 30. The constraint on the flow of the mastic 170 can also maintain the mastic 170 in place to provide electrical stress relief. By obviating or reducing the need for additional tape wraps on the connector 130, the connector system 101 can provide a greater connector surface area 135C to engage the Faraday cage 124 of the joint body 120. According to some embodiments, the length D3 (FIG. 8) of the contact region between the exposed outer surface 135C and the Faraday cage 124 is at least 0.5 inch.

Various environmental parameters may encourage or induce flow of the mastic 170 toward the cable 60. In service, environmental and electrical resistance heating of the connection and conductors heats the mastic 170, thereby softening and reducing the viscosity of the mastic 170. The joint body 120 applies radially inward compressive forces to the mastic 170 that tend to force the mastic 170 toward the connector end 132A. Thermal expansion of joint components may also tend to force flow of the mastic 170.

The connector system 101 according to embodiments of the present invention can prevent, limit or inhibit such unintended and undesirable flow, displacement or extrusion of the mastic 170. The O-ring 150 blocks or dams the mastic 170 so that the mastic 170 is retained about the joint. According to some embodiments, the tape 160 adheres or bonds to the O-ring to provide a seal against mastic flow at the interface between the O-ring 150 and the tape 160.

Figure 11:
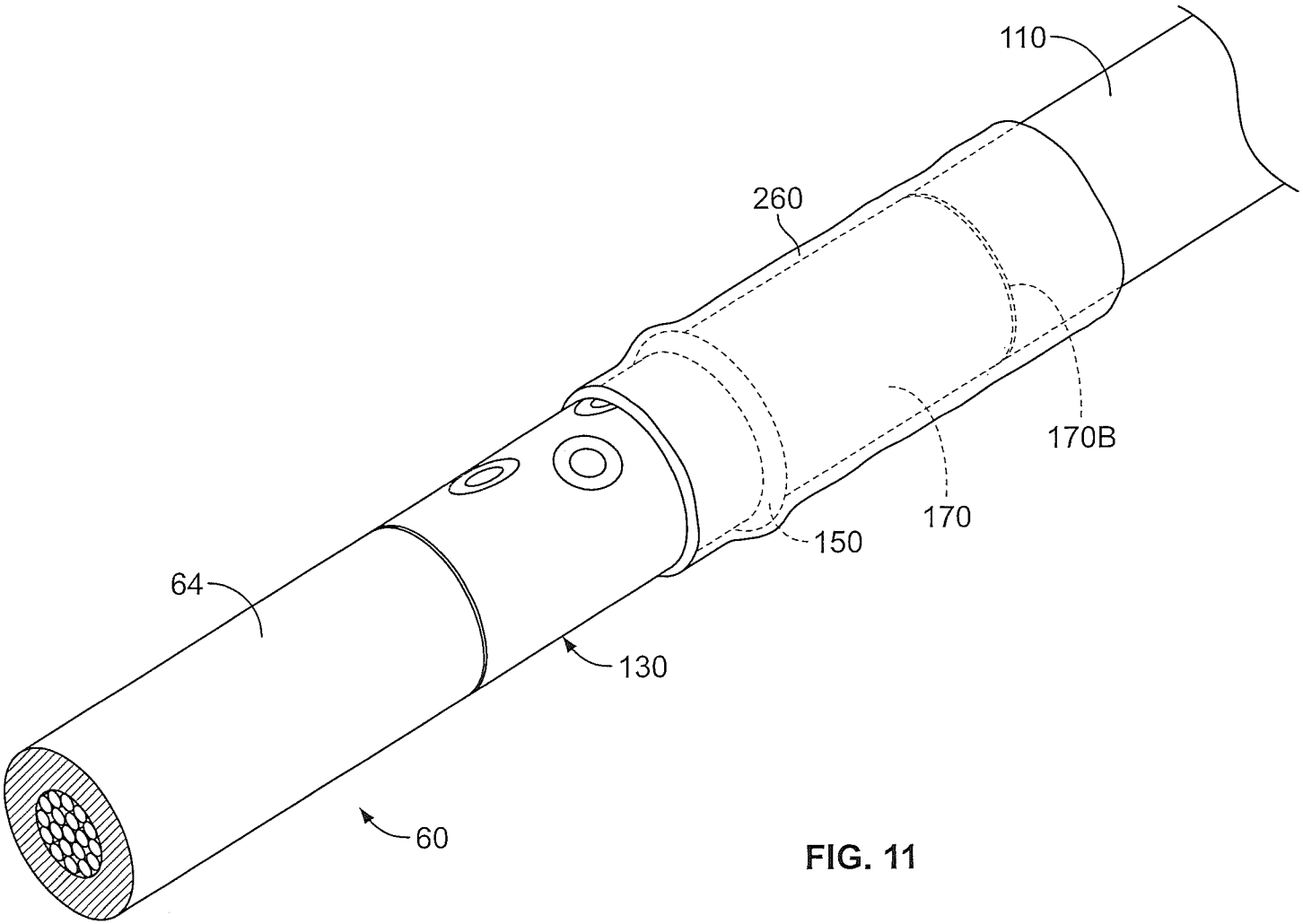
FIG. 11 is a fragmentary, perspective view of a connection assembly according to further embodiments of the present invention.

With reference to FIG. 11, a connector system 201 according to further embodiments of the present invention is shown therein. The connector system 201 can be constructed and assembled in the same manner as the connector system 101 (including incorporation into a cover system corresponding to the cover system 102 to form a protected connection assembly corresponding to the protected connection assembly 104), except as follows. The connector system 201 includes a restricting tube 260 in place of the restricting tape 160. The restricting tube 260 engages and forms a seal with the O-ring 150 in the same or similar manner as described above to restrict flow of the mastic 170 down the length of the connector 130 toward the polymeric cable 60.

The restricting tube 260 may be provided on and deployed from a holdout, for example. According to some embodiments, the restricting tube 260 is a heat shrinkable tube and the procedure for installing the restricting tube 260 includes applying heat (e.g., using a heat gun) to the restricting tube 260 after the tube 260 has been positioned over the mastic 170. According to some embodiments, the restricting tube 260 is a cold shrinkable tube.

According to some embodiments, the restricting tube 260, when installed, is elastically stretched (i.e., has a relaxed diameter that is greater than its installed diameter) so that the restricting tube 260 applies a persistent radially compressive load or pressure on the mastic 170.

The restricting tube 260 may be of any suitable construction and materials. Suitable materials for the tube 260 may include polyolefin or elastomeric materials, for example. In the case of a heat shrinkable tube 260, the tube 260 may be formed of Kynar, polyethylene, or silicone, and may be electrical stress grading or insulating. In the case of a cold shrinkable tube 260, the tube 260 may be formed of silicone or EPDM, and may be electrical stress grading or insulating.

Figure 12:
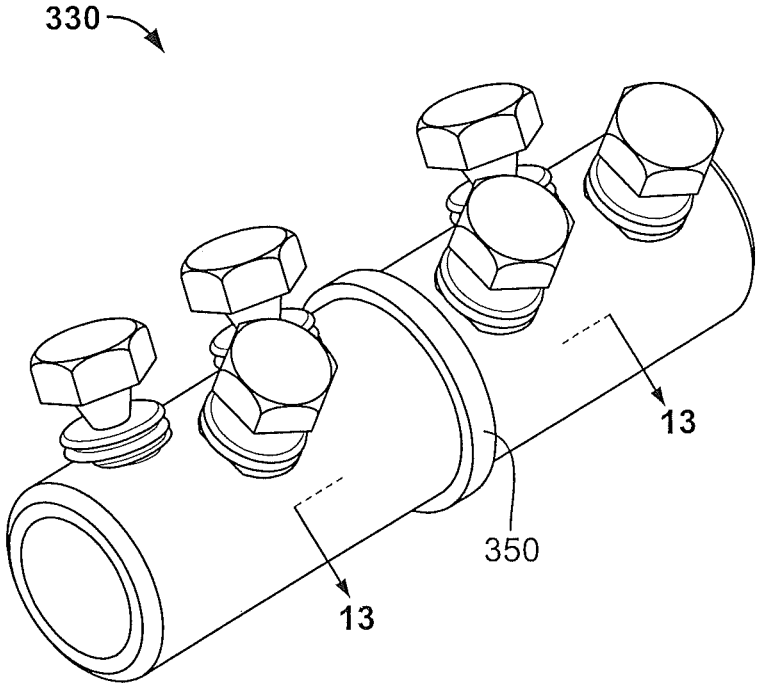
FIG. 12 is a perspective view of a connector according to further embodiments of the present invention.
Figure 13:
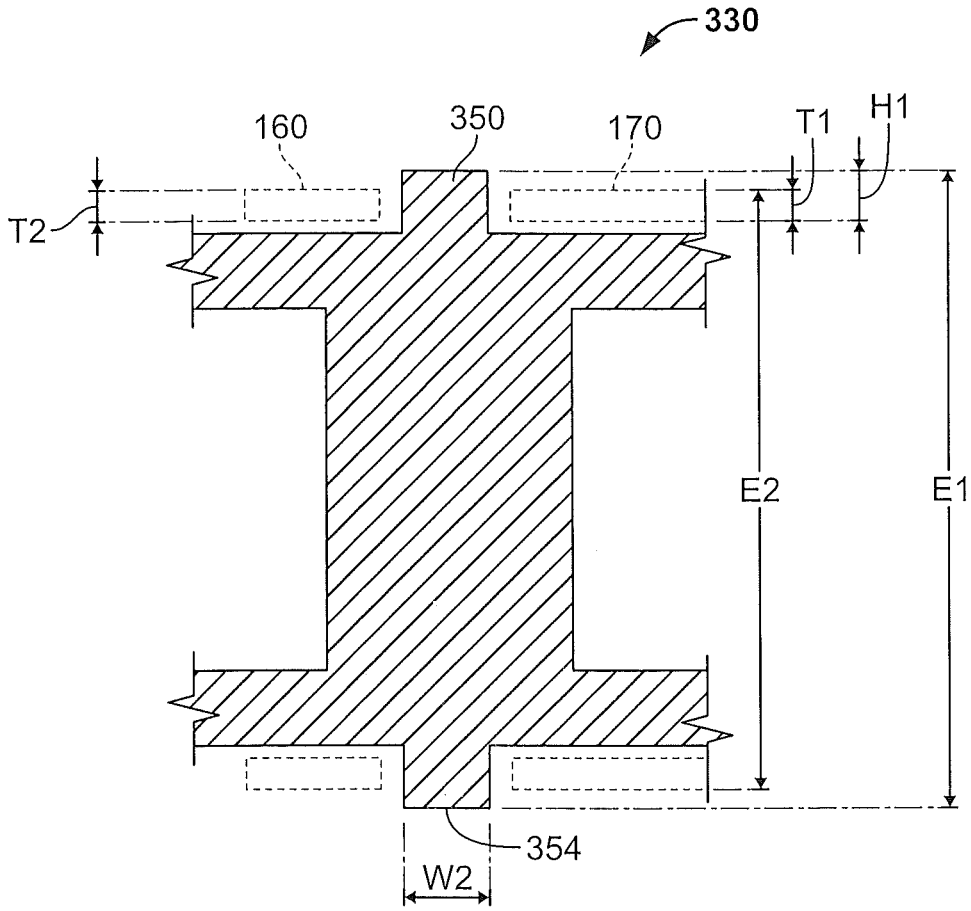
FIG. 13 is an enlarged, fragmentary, cross-sectional view of the connector of FIG. 12 taken along the line 13-13 of FIG. 12.

With reference to FIGS. 12 and 13, a connector system 330 according to further embodiments of the present invention is shown therein. The connector system 330 can be constructed and assembled in the same manner as the connector 130 and used in the connector system 101 (including incorporation into a cover system corresponding to the cover system 102 to form a protected connection assembly corresponding to the protected connection assembly 104) in the same manner as the connector 130, except as follows. The connector 330 corresponds to the connector 130 except that an annular sealant flow block wall 350 is provided in place of the O-ring 150 and the groove 152. The sealant flow block wall 350 provides a continuous region to seal with the restricting tape 160 and restrict the flow of the mastic 170 in the same or similar manner as described about for the O-ring 150. The connector 330 may likewise be used with the restricting tube 260 in place of the restricting tape 160.

The sealant flow block wall 350 may have the same dimensions (i.e., height H1 and/or outer diameter E1) relative to the dimensions of the mastic 170 (i.e., T1 and E2) and the restricting tape 160 (i.e., T2) as discussed above with regard to the O-ring 150. According to some embodiments, the sealant flow block wall 350 has an outer wall face 354 with a width W2 (FIG. 13) of at least from about 0.5 mm to provide reliable engagement between the restricting tape 160 and the sealant flow block wall 350.

According to some embodiments, the wall 350 is rigid. According to some embodiments, the wall 350 has a Rockwell hardness of at least 40 on E scale (HRE 40).

The sealant flow block wall 350 may be formed of any suitable material. According to some embodiments, the sealant flow block wall 350 is formed of metal. Suitable metals may include copper or aluminum. In some embodiments, the sealant flow block wall 350 is formed of the same metal as the connector body 132.

The sealant flow block wall 350 may be formed using any suitable technique. According to some embodiments and as shown in FIG. 13, the sealant flow block wall 350 is integrally formed with the connector body 132, such as by casting or machining, so that the connector body 132 and the sealant flow block wall 350 form a monolithic unit. In other embodiments, the sealant flow block wall 350 is separately formed from and affixed to the connector body 132 such as by adhesive bonding, welding or interference fit.

While sealant flow block walls in the form of an O-ring 150 and a rigid wall 350 have been shown and described herein, sealant flow block walls of other shapes, configurations and materials may instead be employed in accordance with other embodiments of the invention.

While a mastic has been shown and described herein, other flowable sealants (e.g., greases) may be employed with connectors of the present invention.

According to further embodiments of the invention, the connector (e.g., the connector 130) is a crimp-type connector rather than a bolt-type connector.

Connector systems according to embodiments of the invention may be used for any suitable cables and connections. Such connector systems may be adapted for use, for example, with connections of medium voltage cables (i.e., between about 8 kV and 46 kV).

While the connections to PILCs have been described herein with reference to PILC-to-polymeric cable transition splices, connector systems as disclosed herein may also be used in PILC-to-PILC splices and polymeric cable-to-polymeric cable splices. Connector systems according to embodiments of the invention may also be configured for non-splice cable terminations and elbows, for example, for PILC cables and polymeric cables.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A cable connection assembly comprising:

an electrical cable including a conductor;

an electrically conductive connector including:

a connector body having an outer surface and a lengthwise connector axis, the connector body defining a conductor cavity receiving the conductor of the electrical cable; and a sealant flow blocking wall on the connector body and extending radially outwardly from the outer surface of the connector body; and a flowable sealant surrounding a portion of the connector body;

wherein the sealant flow blocking wall is configured to inhibit flow of the sealant on the outer surface along the lengthwise connector axis;

wherein the sealant is flowable in service;

wherein the sealant flow blocking wall is ring-shaped; and wherein the sealant flow blocking wall is a resilient O-ring.

2. The cable connection assembly of claim 1 wherein the connector body includes an annular groove defined in the outer surface thereof, and the O-ring is seated in the groove.

3. The cable connection assembly of claim 1 wherein the O-ring is formed of an elastomeric material.

4. The cable connection assembly of claim 1 wherein the flowable sealant is a mastic.

5. The cable connection assembly of claim 4 wherein the flowable sealant is a mastic formed of nitrile rubber, epichlorhydrin rubber, or fluorinated rubber.

6. The cable connection assembly of claim 4 wherein the flowable sealant is a mastic including an electrical stress relief material.

7. The cable connection assembly of claim 4 wherein the flowable sealant is a mastic having a permittivity of at least about 7.

8. The cable connection assembly of claim 4 wherein the flowable sealant is a mastic that is flowable in a service temperature range of from about −40° C. to 140° C.

9. The cable connection assembly of claim 4 wherein the flowable sealant is a mastic having a viscosity in the range of from about 50 to 100 money units at 100° C.

10. A cable connector system kit for electrically and mechanically connecting an electrical cable, the cable connector system kit comprising an electrically conductive connector including:

a connector body having an outer surface and a lengthwise connector axis, the connector body defining a conductor cavity to receive a conductor of the electrical cable;

a sealant flow blocking wall on the connector body and extending radially outwardly from the outer surface of the connector body; and a flowable sealant adapted to be mounted on the outer surface of the connector body to surround a portion of the connector body;

wherein the sealant flow blocking wall is configured to inhibit flow of the sealant on the outer surface along the lengthwise connector axis;

wherein the sealant is flowable in service;

wherein the sealant flow blocking wall is ring-shaped; and wherein the sealant flow blocking wall is a resilient O-ring.

11. The cable connector system kit of claim 10 wherein the flowable sealant is a mastic.

12. A method for forming an electrical and mechanical connection with an electrical cable, the method comprising:

providing an electrically conductive connector including:

a connector body having an outer surface and a lengthwise connector axis, the connector body defining a conductor cavity to receive a conductor of the electrical cable; and a sealant flow blocking wall on the connector body and extending radially outwardly from the outer surface of the connector body; and mounting a flowable sealant on the connector such that the flowable sealant surrounds a portion of the connector body;

wherein the sealant flow blocking wall is configured to inhibit flow of the sealant on the outer surface along the lengthwise connector axis;

wherein the sealant is flowable in service;

wherein the sealant flow blocking wall is ring-shaped; and wherein the sealant flow blocking wall is a resilient O-ring.

13. The method of claim 12 wherein the flowable sealant is a mastic.

14. A cable connection assembly comprising:

an electrical cable including a conductor;

an electrically conductive connector including:

a connector body having an outer surface and a lengthwise connector axis, the connector body defining a conductor cavity receiving the conductor of the electrical cable; and a sealant flow blocking wall on the connector body and extending radially outwardly from the outer surface of the connector body; and a flowable sealant surrounding a portion of the connector body;

wherein the sealant flow blocking wall is configured to inhibit flow of the sealant on the outer surface along the lengthwise connector axis;

wherein the sealant is flowable in service;

wherein the sealant flow blocking wall is ring-shaped; and wherein the sealant flow blocking wall is a rigid and monolithic with the connector body.

15. A cable connection assembly comprising:

an electrical cable including a conductor;

an electrically conductive connector including:

a connector body having an outer surface and a lengthwise connector axis, the connector body defining a conductor cavity receiving the conductor of the electrical cable; and a sealant flow blocking wall on the connector body and extending radially outwardly from the outer surface of the connector body; and a flowable sealant surrounding a portion of the connector body;

wherein the sealant flow blocking wall is configured to inhibit flow of the sealant on the outer surface along the lengthwise connector axis;

wherein the sealant is flowable in service;

wherein the sealant flow blocking wall is ring-shaped; and wherein the sealant flow blocking wall is rigid and formed of metal.

16. A cable connection assembly comprising:

an electrical cable including a conductor;

an electrically conductive connector including:

a connector body having an outer surface and a lengthwise connector axis, the connector body defining a conductor cavity receiving the conductor of the electrical cable; and a sealant flow blocking wall on the connector body and extending radially outwardly from the outer surface of the connector body; and a flowable sealant surrounding a portion of the connector body;

wherein the sealant flow blocking wall is configured to inhibit flow of the sealant on the outer surface along the lengthwise connector axis;

wherein the sealant is flowable in service; and wherein the sealant is only present on one axial side of the sealant flow blocking wall.

* * * * *